US006848379B1

(12) United States Patent
Ylipelkonen

(10) Patent No.: US 6,848,379 B1
(45) Date of Patent: Feb. 1, 2005

(54) ADJUSTABLE BOAT LIFT STANCHION

(75) Inventor: Riku Ylipelkonen, Ft. Myers, FL (US)

(73) Assignee: Quality Boat Lifts, Inc., Fort Myers, FL (US)

( * ) Notice: Subject to any disclaimer, the term of this patent is extended or adjusted under 35 U.S.C. 154(b) by 0 days.

(21) Appl. No.: 10/437,483

(22) Filed: May 14, 2003

Related U.S. Application Data

(60) Provisional application No. 60/380,443, filed on May 14, 2002.

(51) Int. Cl.[7] ..... B63C 7/00
(52) U.S. Cl. ..... 114/44; 405/3
(58) Field of Search ..... 114/44–48; 405/1, 405/3–5, 7

(56) References Cited

U.S. PATENT DOCUMENTS 4,468,150 A * 8/1984 Price ..... 405/7
5,888,019 A * 3/1999 Quastad ..... 405/3

* cited by examiner

*Primary Examiner*—Jesus D. Sotelo
(74) *Attorney, Agent, or Firm*—William E. Noonan

(57) ABSTRACT

An adjustable stanchion assembly for a large capacity boat lift includes a pair of guides, namely mounting channels that are attached to respective sides of a cradle beam. Each mounting channel slidably receives an elongate stanchion element. The positioning of the stanchion element within its respective mounting channel is selectively adjusted. A bunk member is attached to and extends between upper ends of the stanchion elements. The bunk member is pivotably connected to the stanchion elements so that the angle of the bunk member may be adjusted.

20 Claims, 5 Drawing Sheets

ADJUSTABLE BOAT LIFT STANCHION

RELATED APPLICATION

This application claims the benefit of U.S. application Ser. No. 60/380,443, filed May 14, 2002.

FIELD OF THE INVENTION

This invention relates to an adjustable stanchion for use on a boat lift and, more particularly, to a stanchion for adjusting the position of a supporting bunk in a sailboat lift or other large capacity lift.

BACKGROUND OF THE INVENTION

Large capacity boat lifts typically employ a lift platform having a plurality of transverse cradle beams that carry bunk assemblies for engaging and supporting the hull of the vessel. It is critical that the bunks be properly positioned to support the boat in a level manner on the lift. Sailboats and heavy vessels exhibit a wide variety of hull sizes and contours. As a result, the bunks of a standard lift tend to engage different vessels at different locations and angles. Uniformly level support is virtually impossible to achieve. Therefore, each large capacity boat lift typically must be custom manufactured to position the bunks in a suitable manner so that level support is provided for the particular boat with which the lift will be used. Specifically, the bunks are supported by stanchions which must be measured, pre-drilled and assembled individually for each customer. Before the lift is constructed, the manufacturer must carefully and accurately ascertain the precise specifications of the customer's vessel.

The foregoing technique is tedious, time consuming, costly and inefficient. If the specifications are measured incorrectly or if the customer elects to use a different vessel with the lift, the originally installed bunk positioning must be changed. This usually requires time consuming and expensive reconstruction of the lift. After the position is initially set, it is virtually impossible to adjust on site. For that reason, the large capacity boat lifts which are currently available are normally suited for use with only one type of vessel. This limits the versatility and usefulness of the lift considerably. Custom lift construction must be performed for virtually each type of vessel. If the boater later decides to change vessels, time consuming and costly retrofitting of the lift must be performed.

SUMMARY OF THE INVENTION

It is therefore an object of this invention to provide an adjustable stanchion for a boat lift, which stanchion may be quickly and conveniently adjusted to properly and supportively engage a boat hull having virtually any size or shape.

It is a further object of this invention to provide an adjustable boat lift stanchion that eliminates the need to custom manufacture a large capacity boat lift in order to accommodate the particular vessel to be lifted and which, instead may be efficiently manufactured for various vessel sizes, shapes and weights.

It is a further object of this invention to provide an adjustable boat lift stanchion which allows the bunks of the boat lift to be conveniently adjusted on site so that they will properly and securely support the vessels to be lifted.

It is a further object of this invention to provide a large capacity boat lift that is much more versatile than existing lifts.

It is a further object of this invention to provide an adjustable boat lift stanchion that avoids the time and expense of having to be completely reconstructed and re-installed if the measured specifications are inaccurate or if the lift is used for a different vessel than originally intended.

It is a further object of this invention to provide an adjustable boat lift stanchion which does not have to be custom constructed for each vessel and which instead may be quickly and conveniently adjusted to accommodate virtually all sizes and shapes of boat hulls.

It is a further object of this invention to provide an adjustable boat lift stanchion that is quickly and conveniently adjusted either prior to installation of the lift or in the water after the lift has been installed.

It is a further object of this invention to provide an adjustable boat lift stanchion that reduces the need to take tedious and often unreliable measurements of the boat to be lifted prior to manufacturing, assembling and installing the lift.

This invention features an adjustable stanchion assembly for a boat lift, which boat lift includes a lift platform having a plurality of transverse cradle beams and a plurality of bunk members carried by the cradle beams for supportively engaging the hull of the vessel mounted on the lift platform. The stanchion assembly includes a pair of channel members attached to respective sides of one of the cradle beams. Elongate first and second stanchion elements are slidably received in respective channels. Each stanchion element is selectively lockable in one of a plurality of longitudinal positions within the channel member. A respective bunk member extends between the first and second stanchion elements and is pivotably connected to respective upper ends thereof. The stanchion elements are selectively raised and lowered within their respective channel members and the bunk member is selectively pivoted relative to the stanchion elements to position the bunk member supportively against the hull of a boat supported by the lift.

In a preferred embodiment, the bunk member may be connected to the first and second stanchion elements by respective threaded stud assemblies. Each threaded stud assembly may include an exteriorly threaded stud that is slidably interengaged with a respective stanchion element. Each stanchion element may comprise a tube that slidably receives a respective stud. A nut may threadably interengage the exterior threads of the stud. A lower end of the nut may engage the upper end of the stanchion element. By threading the nut along the exterior threads of the stud, the stud is raised and lowered relative to the stanchion elements. An upper portion of the stud may be pivotably connected to the bunk member. A jamb assembly may be employed for locking the bunk element at a selected pivoted position. The jamb assembly may include a hole formed through a pivot bracket that depends from the bunk member and a series of complementary holes formed in the upper end of the stud and selectively registerable with the hole in the depending bracket. A pin or other element is inserted into the registered holes to lock the bunk in a desired angular position.

The mounting channels may be attached to respective sides of the cradle beam by mounting plates. Each mounting plate may be bolted, welded or otherwise secured to the cradle beam. In turn, the mounting channel may be welded to the mounting plate. The mounting channel preferably comprises a mounting tube, which may include a tube having a rectangular cross sectional shape. The stanchion element preferably comprises a cylindrical tube.

The elongate stanchion element preferably includes a series of adjustment holes formed longitudinally on the cylindrical tube or other stanchion element. These holes are selectively registered with a complementary hole formed in the mounting channel. A pin is inserted through the registered holes to lock the stanchion element at a desired longitudinal position within the mounting channel.

In an alternative version of this invention, which is typically featured in a sailboat lift, the mounting channel may be pivotably connected to a mounting plate or otherwise hingedly connected to the cradle beam. In such cases, the stanchion elements and the bunk member supported thereby, are pivotable in unison relative to the cradle beam. The mounting channel may carry a positioning hole which is selectively registered with one of a plurality of complementary positioning holes formed in the mounting plate. A pin may be inserted through the registered holes to lock the stanchion elements and attached bunk member in a desired angular position relative to the mounting plate and the cradle beam.

DETAILED DESCRIPTION OF PREFERRED EMBODIMENTS

Other objects, features and advantages will occur from the following description of preferred embodiments and the accompanying drawings, in which.

Figure 1:
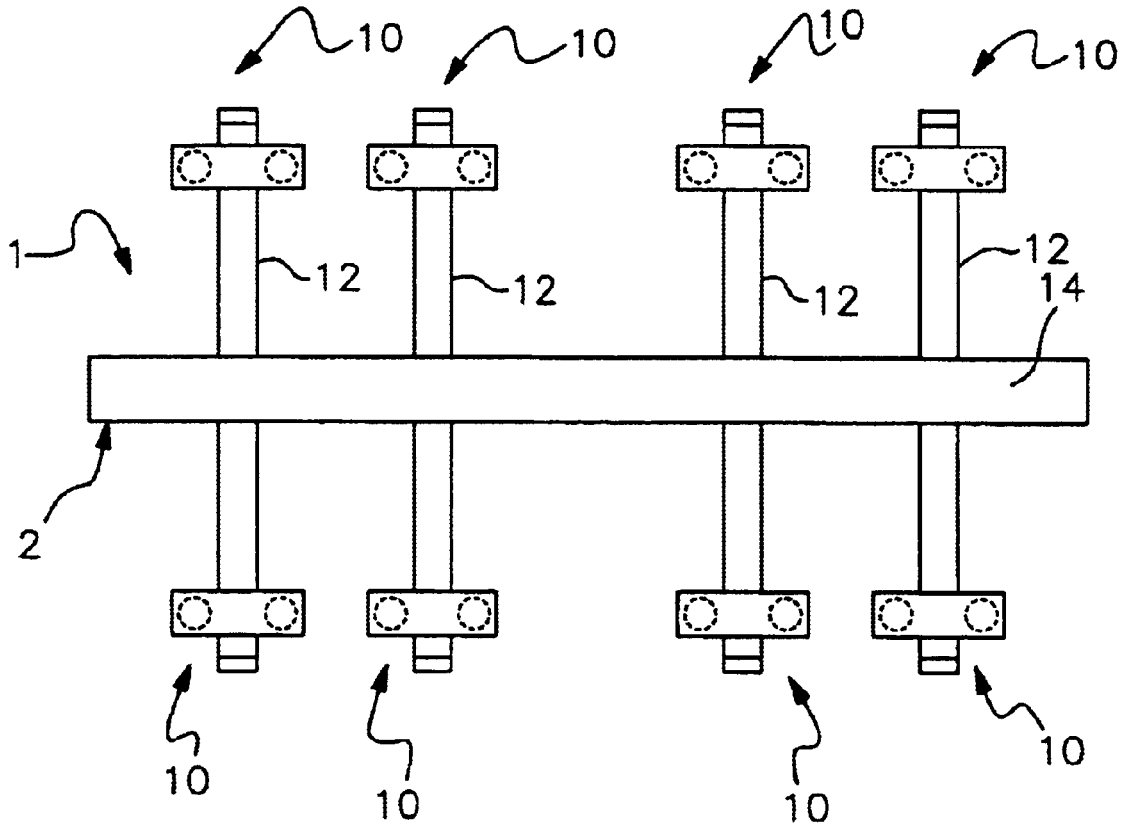
FIG. 1 is an top plan view of a boat lift employing the adjustable stanchions of this invention.

There is shown in FIG. 1 a large capacity boat lift 1 that employs eight adjustable stanchion assemblies 10 according to this invention. Typically, boat lift 1 is a large capacity lift for raising and lowering vessels having a weight of 32,000 pounds or greater. It should be understood that lift 1 is depicted in somewhat simplified form and much of the detail of the lift has been omitted for clarity. The novel aspects of this invention are the adjustable stanchion assemblies 10. It should be understood that the remaining components of the lift, including the drive components (which are entirely omitted) and the other operational aspects of lift platform 2 are conventional and do not comprise a part of this invention.

Figure 2:
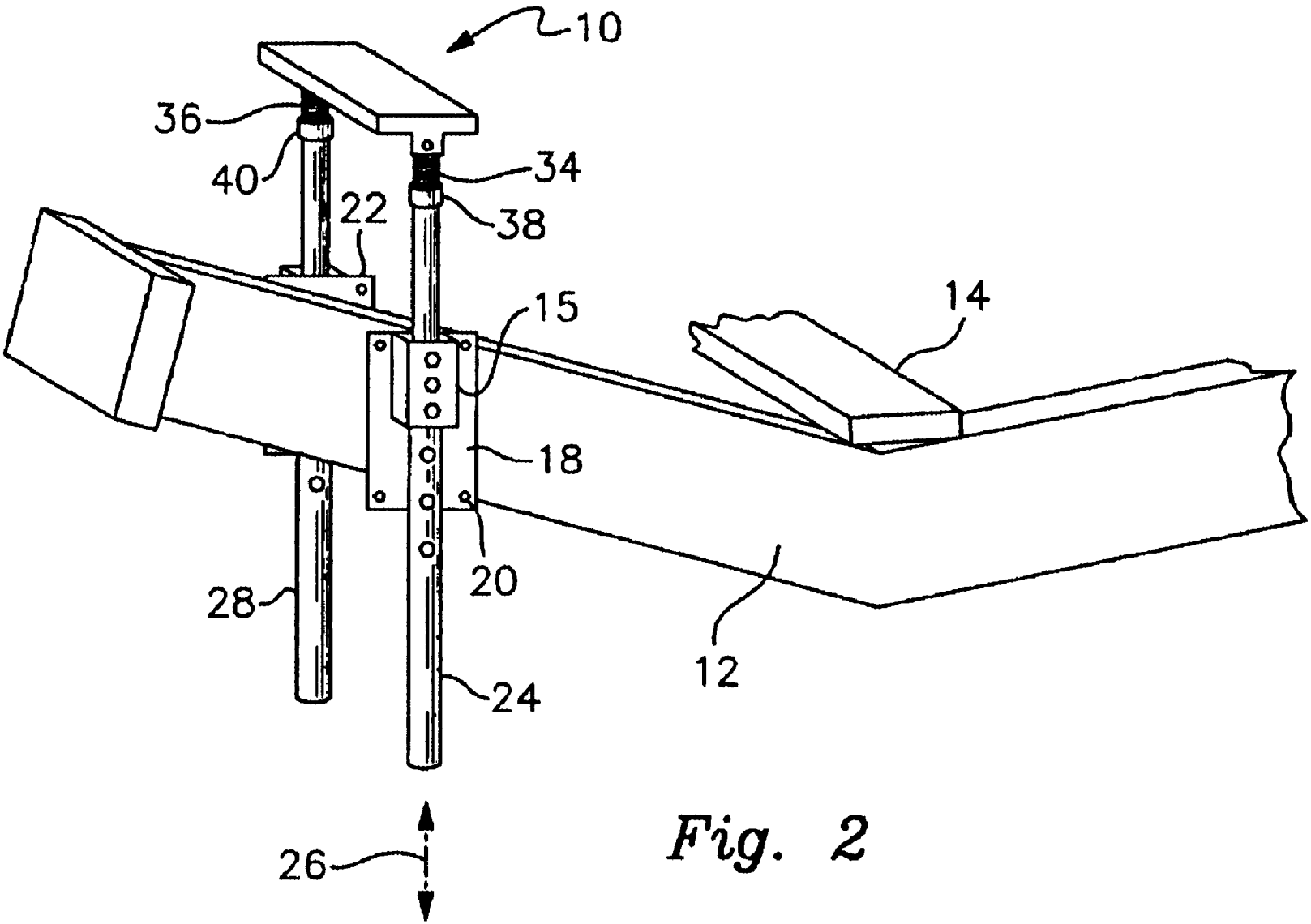
FIG. 2 is a partial perspective view of a single cradle beam and an adjustable stanchion assembly attached to that beam.

Lift platform 2 specifically includes a plurality of transverse cradle beams 12, which typically comprise (or other lightweight material) I-beams. In large capacity or sailboat lifts, these I-beams form a generally V-shaped configuration as best shown in FIG. 2. It should be understood, however, that the invention may also be used in cases where the I-beams are perfectly straight across the entire width of the platform 2. Normally, a series of cables, not shown, are connected to the cradle beams of platform 2. The drive mechanism of the lift selectively raises and lowers the cables to elevate and drop the lift platform respectively. A carpeted keel beam 14, FIGS. 1 and 2, is normally mounted on the cradle beams and extends along the longitudinal axis of the platform. This beam is normally engaged by the keel of the vessel supported on the lift platform.

Figure 3:
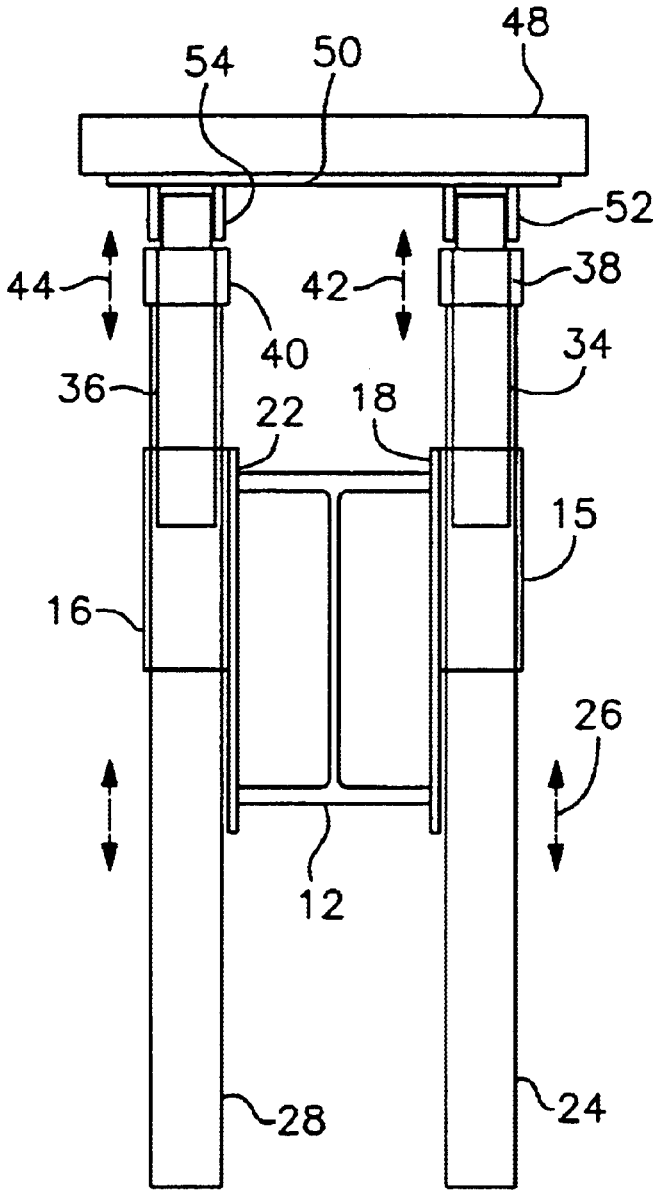
FIG. 3 is an elevational side view of the adjustable stanchion assembly as mounted to a cradle beam.
Figure 4:
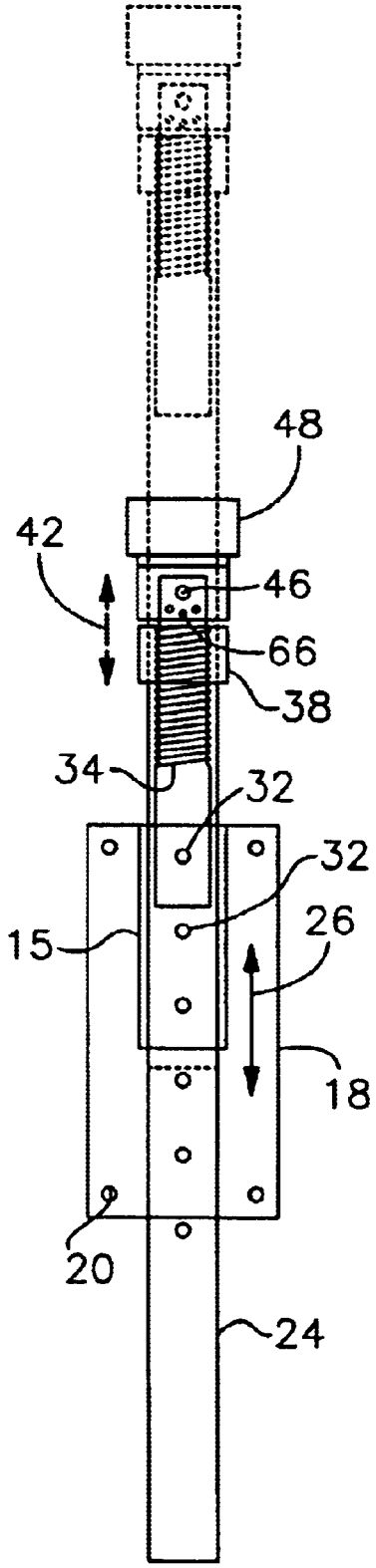
FIG. 4 is an elevational end view of the stanchion assembly in both retracted and extended conditions.

As best shown in FIG. 1, a stanchion assembly 10 is mounted in a conventional manner proximate each end of each cradle beam 12. A representative stanchion assembly 10 is depicted in FIGS. 2–4. Specifically, each stanchion assembly includes a pair of guides comprising mounting channels 15 and 16 that are attached respectively to front and back sides of the cradle beam 12. More particularly, a forward mounting plate 18 is secured to the front of I-beam 12 by bolts 20. Channel member 15, which typically comprises a rectangular metal tube, is welded or otherwise secured to the outer face of outer face of plate 18. Tubular channel member 16 is similarly secured to a mounting plate 22 that is bolted or otherwise attached to the backside of beam 12.

Figure 5:
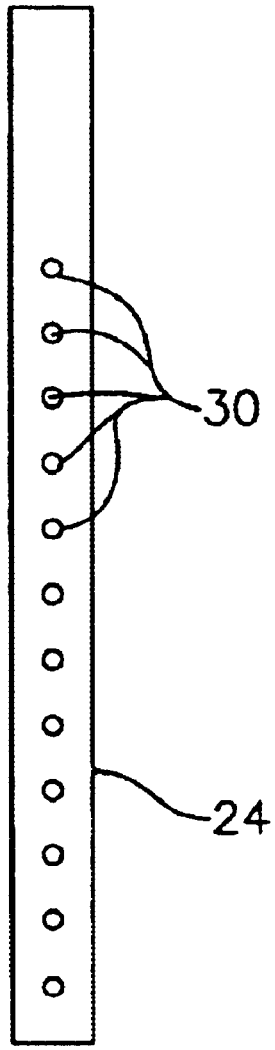
FIG. 5 is an elevational side view of the elongate stanchion element including a plurality of position adjustment holes formed therein.

An elongate tubular stanchion member 24 is slidably received by tubular mounting channel 15 such that the stanchion member 24 is movable selectively in upward and downward directions through the channel member, as indicated by doubleheaded arrow 26. A second elongate tubular stanchion member 28 is similarly mounted slidably within mounting channel 16. As best shown in FIG. 5, a series of positioning holes 30 are arranged longitudinally along stanchion element 24 (and similarly along stanchion element 28). These positioning holes are selectively aligned or registered with complementary positioning holes 32 formed in mounting channels 15 and 16. The vertical positioning of elements 24 and 28 within mounting channels 15 and 16 respectively may be adjusted by aligning holes 30 and 32 as desired and inserting appropriate pins through the aligned holes to lock the stanchion elements in a desired position and at a desired height relative to the mounting channels. The purpose of this operation is described more fully below. It should be understood that the number of positioning holes in the stanchion elements and their associated mounting channels may be varied within the scope of this invention.

A first exteriorly threaded stud 34 is received by the bore in the upper end of stanchion element 24. Likewise, a second exteriorly threaded stud 36 is received by stanchion element 28. Adjustment nuts 38, 40 are threadably engaged with studs 34, 36, respectively. The lower end of nut 38 engages the upper end of tubular stanchion element 24. Likewise, the lower end of nut 40 engages the upper end of stanchion element 28. By threadably adjusting the nuts along their respective exteriorly threaded studs, the studs may be raised and lowered relative to the stanchion elements with which they interengage. As a result, threaded stud 34 may be adjusted upwardly and downwardly relative to element 24 as indicated by doubleheaded arrow 42. Likewise, stud 36 may be moved upwardly and downwardly relative to 28 as indicated by doubleheaded arrow 44.

Figure 6:
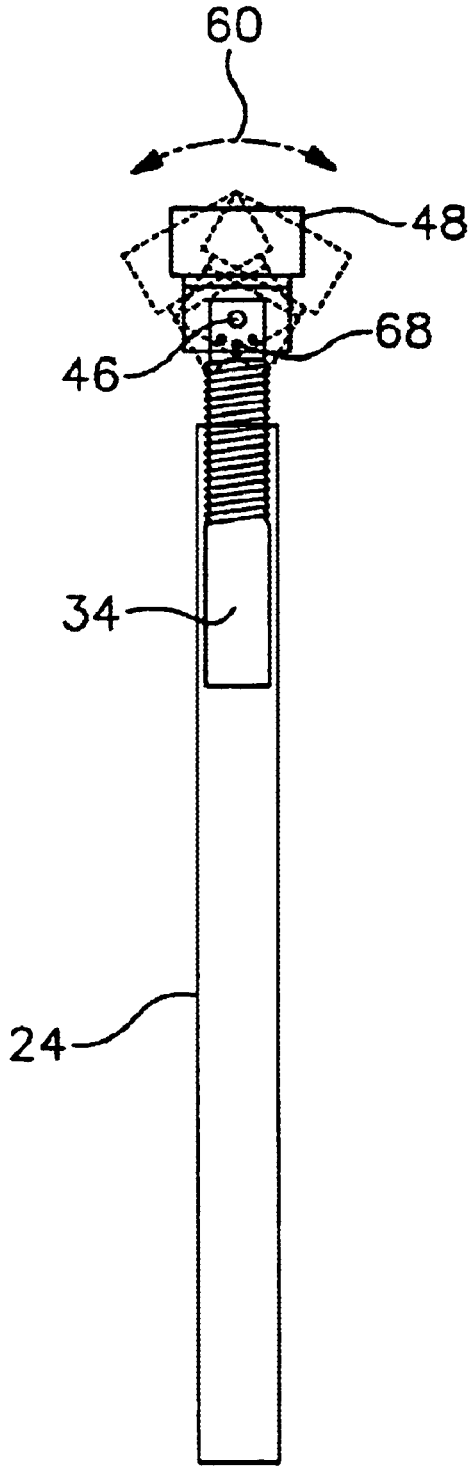
FIG. 6 is an elevational end view of the stanchion assembly, threaded stud and bunk member, with the pivotability of the bunk member particularly shown; and In FIGS. 7–10 are elevational end views depicting the stanchion element and attached bunk member pivotably connected to the mounting plate and in various respective angular positions relative thereto.
Figure 10:
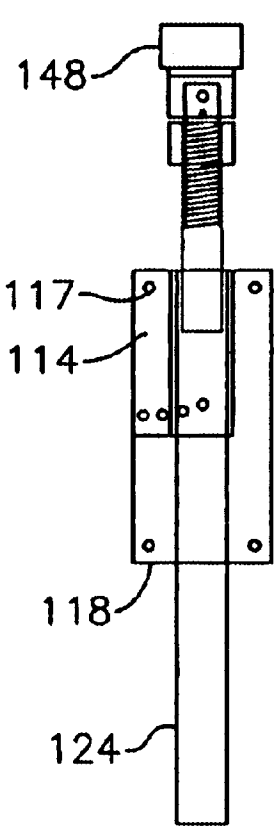
Figure 9:
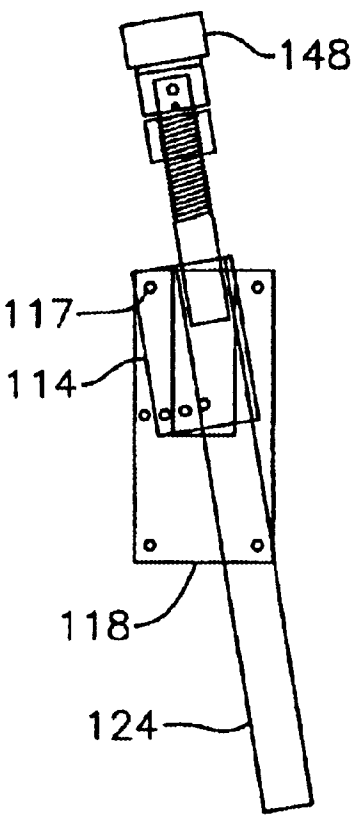
Figure 8:
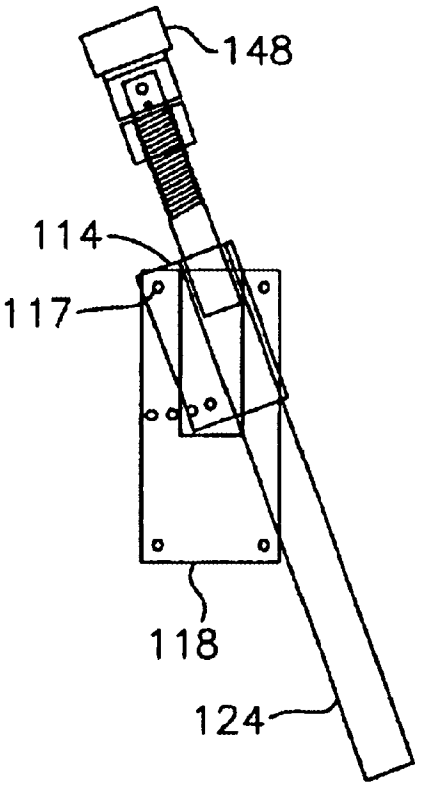
Figure 7:
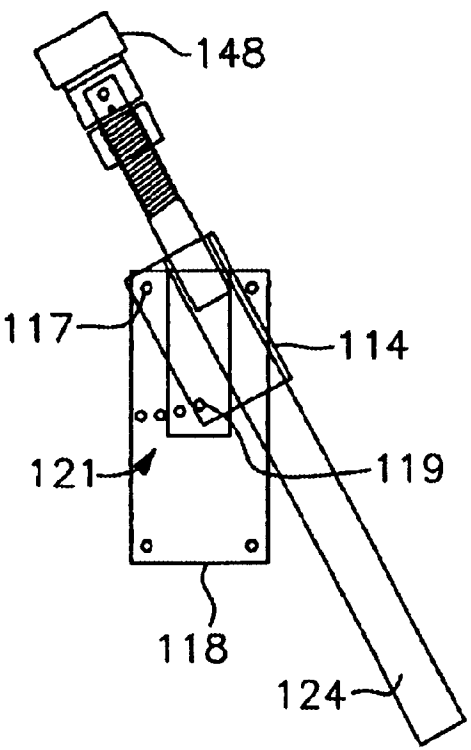

As best shown in FIG. 4, the upper end of stud 34 carries a pivot 46 that tiltably connects a bunk member 48 to the upper end of stud 34. More particularly, the bunk member includes a depending bracket 50 that includes a forward pair of depending hinge plates 52 and a similar rearward pair of hinge plates 54. The forward hinge plates 52 are connected by pivot pin 46 (FIG. 4) to the upper end of stud 34. A similar pin interconnects the rearward hinge plates 54 to the upper end of stud 36. As shown in FIG. 6, this permits bunk member 48 to pivot, in the manner indicated by doubleheaded arrow 60 approximately 300 in either direction from a horizontal position. Once again, it should be understood that a similar construction and operation are exhibited at each end of the bunk member where that member pivotably connects to threaded stud 34 and 36 respectively. A jamb assembly, which again includes selectively registerable holes, may be employed to lock the bunk member at a selected pivot angle. In particular, each of the depending plates 52 and 54 may include aligned holes 66, FIG. 4. A plurality of complementary holes 68, FIG. 6, are formed in the respective threaded stud. When the bunk member is tilted into a desired position, the user inserts a pin or other locking device through the aligned holes in plates 52 and stud 34, as well as plates 54 and stud 36. A selected angular positioning of the bunk member may thereby be maintained.

In operation, the stanchion assemblies 10 may be quickly and conveniently adjusted to stably support virtually all boat hulls in a level fashion. Initially, the lift is manufactured without regard to the particular precise specifications of the boat to be lifted. In this way, the lift may be efficiently mass-produced and costly custom fabrication is largely avoided. After assembly but prior to installing the lift, the specifications of the boat may be measured. The stanchion may then be adjusted as required. Alternatively, this adjustment may be made after the lift is installed. In either case, each stanchion assembly is adjusted in the following manner.

Initially, gross adjustment is performed. Stanchion elements 24 and 28 are slid upwardly or downwardly, as required, through mounting channels 15 and 16 until the approximate desired height of bunk member 48 is achieved. The stanchion elements are then locked within their respective mounting channels by inserting a clip, pin or other locking means through a selected aligned pair of holes in each stanchion element and associated mounting channel.

Fine-tuned height adjustment may then be performed. This is accomplished by threadably turning the adjustment nuts 38 and 40 selectively in clockwise and counterclockwise directions to respectively raise and lower the threaded studs 34 and 36, and therefore the bunk member 48, relative to the previously grossly adjusted stanchion elements 24 and 28. The threaded adjustment allows for very precise and fine-tuned height adjustment of the bunk member so that safe, secure and level support is provided for the vessel.

FIG. 4 depicts the stanchion assembly in phantom with the bunk member held at a raised position. This is typically about 31" above its lowermost position. A fairly wide range of height adjustment is thereby provided.

After the height adjustments are performed, if needed, the bunk member is tilted and locked in place in the manner previously described. It should be understood that the order of the foregoing adjustments may be altered in accordance with this invention. For example, the bunk member may be angularly adjusted before the height adjustments are performed, or alternatively, between the gross and fine height adjustments.

FIGS. 7–10 depict a somewhat modified version of this invention, which is particularly suited for use in a sailboat lift. In this version, only one of the stanchion elements is depicted. It should be understood that a similar construction is utilized for the other stanchion elements, in a manner analogous to the previously described embodiment.

In FIGS. 7–10, stanchion element 124 is again slidably received by a mounting channel preferably in the form of a rectangular tube 114. In this version, however, the rectangular tube is pivotably mounted to mounting plate 118 such as by a mounting pin 117. Channel 114 carries a positioning hole 119 that is selectively registered or aligned with one of a plurality of complementary positioning holes 121 formed in plate 118. Stanchion element 124 is itself pivotable along with mounting channel 114 relative to plate 118. This permits the gross angular adjustment of bunk member 148 through the range of movement shown in FIGS. 7–10. It should be understood that the remaining structure of this version is similar to that previously described. Accordingly, in the second embodiment, there are two forms of pivotable adjustment, i.e. pivoting between bunk member and the stanchion element, as well as relative pivoting between the stanchion elements and the cradle beam. The gross and fine height adjustments of the previously described embodiment are also provided.

In accordance with the teaching of the present invention, the bunk members of a large capacity boat lift may be quickly and conveniently adjusted for virtually all types of sailboats and heavy vessels. The need to custom manufacture the lift, and in particular the stanchions, is largely eliminated. Substantial time and expense is saved and the lift exhibits much improved versatility and efficiency, both for the manufacturer and the user.

The components of the adjustable stanchion assembly, including the stanchion elements, plates, tubular channels and brackets typically comprise aluminum or steel. Other durable metals, metal alloys and synthetic materials may be used within the scope of this invention.

From the foregoing it may be seen that the apparatus of this invention provides for an adjustable stanchion for use on a boat lift. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. An adjustable stanchion assembly for a boat lift having a boat supporting lift platform, said stanchion assembly comprising:

a guide section for attaching to the lift platform; and an elongate stanchion section interengaged with said guide section and supporting a bunk section proximate an upper end of said stanchion section; said assembly further including at least one threaded connector for interconnecting said bunk section and said stanchion section; said stanchion section being longitudinally adjustable relative to said guide section to selectively raise and lower said bunk section; and said bunk section being angularly tiltable relative to said lift platform to position said bunk section supportively against the hull of a boat supported by the lift platform.

2. The assembly of claim 1 in which said guide section includes a generally tubular mounting channel.

3. The assembly of claim 2, in which said channel is fixedly attachable to the lift platform.

4. The assembly of claim 2 in which said channel is mounted to a plate that is fixable to the lift platform.

5. The assembly of claim 2 in which said mounting channel is pivotally attachable to the lift platform.

6. The assembly of claim 1 in which said threaded connector includes an exteriorly threaded stud and said stanchion section includes an elongate tubular element that slidably receives said stud, said assembly further including a nut that threadably interengages said exteriorly threaded stud, said nut having a lower end that engages an upper end of said tubular element, said nut being threadably adjusted along said stud to selectively raise and lower said stud relative to said tubular element.

7. The assembly of claim 6 in which said bunk section is pivotally connected to said stud.

8. The assembly of claim 7 further including a jamb mechanism for locking said bunk section at a selected position pivotally relative to said stud.

9. The assembly of claim 8 in which said jamb mechanism includes a hole formed through a pivot bracket that depends from said bunk section and a series of complementary holes formed in said stud and selectively registerable with said hold in said bracket, and further including a pin insertible into the registered holes to lock said bunk section in a selected angular position.

10. The assembly of claim 1 in which said stanchion section includes an elongate stanchion element having a longitudinal series of height adjustment holes, said guide section slidably receiving said stanchion element and having a complementary height adjustment hole that is registerable with a selected one of said series of holes in said elongate element, a locking pin being inserted through said registered height adjustment holes to lock said stanchion element at a selected longitudinal position relative to said guide section.

11. An adjustable stanchion assembly for a boat lift, which boat lift has a boat supporting lift platform that includes at least one cradle beam extending transversely to the axis of a boat supported on the lift platform, said stanchion assembly comprising:

a guide section including a pair of guide channels that are attachable to respective sides of the cradle beam; and an elongate stanchion section interengaged with said guide section and including a pair of elongate stanchion elements which support a bunk member proximate the respective upper ends of said stanchion elements; each stanchion element being slidably interengaged with and longitudinally adjustable relative to a respective one of said guide channels for selectively raising and lowering said bunk section, said bunk section being angularly tiltable relatively to said lift platform to position said bunk section supportively against the hull of a boat supported by the lift platform.

12. The assembly of claim 11 in which each stanchion element is interconnected to said bunk section by a respective threaded connector.

13. The assembly of claim 12 in which each threaded connector includes an exteriorly threaded stud and each stanchion element includes an elongate tubular element that slidably receives a respective said stud, said assembly further including a pair of nut components, each of which threadably interengages a respective one of said exteriorly threaded studs, each said nut component having a lower end that engages an upper end of a respective one of said tubular elements, said nut elements being adjusted along said respective studs to selectively raise and lower said studs and said attached bunk section relative to said stanchion section.

14. The assembly of claim 13 in which said bunk section is pivotally connected to said studs.

15. The assembly of claim 14 further including a jamb mechanism for selectively locking said bunk section at a selected position pivotally relatively to said studs.

16. The assembly of claim 15 in which said jamb mechanism includes a hole formed through a pivot bracket that depends from said bunk section and a series of complementary holes formed in said stud and selectively registerable with said hole in said bracket, and further including a pin insertible into the registered holes to lock said bunk section in a selected angular position.

17. The assembly of claim 11, in which said guide channels are mounted to respective plates that are fixable to opposite sides of the cradle beam.

18. The assembly of claim 11, in which each stanchion element has a longitudinal series of holes, each said guide channel slidably receiving a respective one of said stanchion elements and having a complementary hole that is registerable with a selected one of said series of holes in said elongate element interengaging said guide channel, a locking pin being inserted through said registered holds to lock said stanchion element at a selected longitudinal position relative to said guide section.

19. An adjustable stanchion assembly for a boat lift having a boat supporting lift platform, said stanchion assembly comprising:

a guide section for attaching to the lift platform, said guide section including a generally tubular mounting channel that is pivotably attachable to the lift platform; and an elongate stanchion section interengaged with said guide section and supporting a bunk section proximate an upper end of said stanchion section; said stanchion section being longitudinally adjustable relative to said guide section to selectively raise and lower said bunk section; and said bunk section being angularly tiltable relative to said lift platform to position said bunk section supportively against the hull of a boat supported by the lift platform.

20. The assembly of claim 19 in which said mounting channel carries a pivot position opening and further including a positioning member attachable to the lift platform, said positioning member having a plurality of complementary pivot position openings, each of which is selectively registerable with said pivot position opening in said mounting channel such that a pin is insertible through the registered pivot position openings to lock said stanchion section and said bunk member in a selected angular position relative to said positioning member and the lift platform.

* * * * *